US005516000A

United States Patent [19]

Freiburger et al.

[11] Patent Number: 5,516,000

[45] Date of Patent: May 14, 1996

[54] FACIAL TISSUE CARPACK

[75] Inventors: Sarah J. M. Freiburger, Kaukauna; Janica S. Behnke, Appleton, both of Wis.; Stephen J. McPhilliamy, Chicago, Ill.; Richard E. DePaul, Williamsburg, Va.

[73] Assignee: Kimberly-Clark Corporation, Neenah, Wis.

[21] Appl. No.: 348,706

[22] Filed: Dec. 2, 1994

[51] Int. Cl.[6] ..... B65H 1/02

[52] U.S. Cl. ..... 221/48; 221/185; 221/283

[58] Field of Search ..... 221/47, 48, 185, 221/283

[56] References Cited

U.S. PATENT DOCUMENTS

| | | | |
|---|---|---|---|
| 2,101,579 | 12/1937 | Hamer | 221/48 |
| 2,118,380 | 5/1938 | Gresenz | 221/48 |
| 2,770,411 | 11/1956 | MacKay | 229/43 |
| 2,990,950 | 7/1961 | Alexander | 206/57 |
| 3,012,692 | 12/1961 | Petersen | 221/63 |
| 3,089,586 | 5/1963 | Cole | 206/57 |
| 3,121,511 | 2/1964 | Whitehead | 221/283 |
| 3,144,961 | 8/1964 | Phenner | 221/48 |
| 3,289,883 | 3/1965 | Bjorklund | 221/48 |
| 3,369,699 | 2/1968 | Enloe et al. | 221/48 |
| 3,490,645 | 6/1968 | Glass et al. | 221/48 |
| 3,881,649 | 5/1975 | Krautsack | 229/38 |
| 4,175,673 | 11/1979 | McDonald et al. | 221/63 |
| 4,200,200 | 4/1980 | Hein, III et al. | 221/48 |
| 4,646,937 | 3/1987 | Doshi | 221/56 |
| 4,927,052 | 5/1990 | Marthaler et al. | 221/185 X |

*Primary Examiner*—William E. Terrell
*Assistant Examiner*—Dean A. Reichard
*Attorney, Agent, or Firm*—Gregory E. Croft

[57] ABSTRACT

A tissue carton especially adapted for use in automobiles is disclosed. The carton contains a pre-folded (such as c-folded or v-folded) interfolded clip of tissues which dispenses in a pop-up fashion. The tissues are dispensed through the upper edge of the carton. The carton is thin and wide to fit in a variety of locations within an automobile. The carton can also be provided with a hook-and-loop fastener to affix the carton to a convenient surface within the vehicle.

19 Claims, 7 Drawing Sheets

FACIAL TISSUE CARPACK

BACKGROUND OF THE INVENTION

Tissue use in vehicles ranges from nose-blowing to hand-wiping to cleaning up spills. Consumer research shows that the majority of these consumers are not satisfied with the size and shape of currently available facial tissue packages for vehicle use, but nevertheless purchase them because of the need for having facial tissues in the vehicle. Small, low-count packages such as a "pocket packs" are unsatisfactory and sometimes cause the user to purchase full-sized flat or upright tissue cartons. The need for a full-sized tissue also impacts on the consumer's decision to purchase the full-size tissue package since smaller tissue packages often contain smaller-sized facial tissues.

However, the majority of the larger facial tissue packages do not fit into convenient locations within the driver's reach, such as map pockets, dash pockets or console compartments. Consequently tissue packages are usually placed on the front or back seat, the floor, the rear window shelf or glove compartments which may be hard to reach. Placement in these locations also means the packages often get stepped on, sat upon or smashed when something is accidentally placed on top of them, often resulting in damage to the dispensing feature of the carton where the opening is torn or bent, thus causing the tissues to tear while dispensing. Another problem is that the packages move around and can't be found. They slide along the seat, the floor, or under the seat. Packages may become located under the driver's feet or near the car foot pedals, which may create a safety hazard. The fact that the facial tissue packages are often not held securely in place and are difficult to find can also be hazardous if the driver becomes distracted in searching for the tissue package and is unable to use both hands for driving.

Some smaller tissue packages exist, but their dispensing location limits their convenience for use in map pockets and some dash pockets such that, when the package is put into these locations, the dispensing opening is covered up. The package first needs to be removed from its location before the facial tissue can be dispensed. Hence there is a need for a facial tissue package adapted for use in vehicles which provides an adequate quantity of full-sized facial tissues in a small package volume and possesses pop-up convenience.

SUMMARY OF THE INVENTION

It has been discovered that properly designed facial tissue packages solve the current problems with existing facial tissue packages used in vehicles, thus satisfying unmet consumer needs. In general, the carton size and tissue dispensing location are designed to fit into small compartment locations convenient for the driver's use while containing the maximum number of tissues for its size. The narrow carton depth allows the carton to fit into the map pockets, dash pockets and console compartments of the majority of vehicles such as cars, trucks, and minivans. This makes the cartons easy to locate, prevents them from being moved around, and protects them from being damaged. The tissue dispensing slit is located such that the tissue is facing the consumer when the carton is placed in a map pocket, dash pocket, console compartment, etc. rather than being covered up as in existing facial tissue cartons.

An attachment device on the carton can further enhance facial tissue cartons suitable for vehicular use. The benefits include: (1) the carton stays securely in the location in which it was placed by the consumer; (2) the options for carton location are increased; (3) damage to the carton would be minimized by being attached to a surface and placed in a convenient out-of-the way location; and (4) one-handed dispensing is aided by securing the carton.

Hence in one aspect, the invention resides in a pop-up dispensing carton containing a clip of pre-folded, interfolded tissues, said carton comprising a front wall, a rear wall, two side walls connecting the front and rear walls, a top wall, a front edge between the front wall and top wall, and a back edge between the back wall and the top wall, wherein the front and back walls are about 5 inches square and the distance between the front and back walls is less than 3 inches, said carton having a carton opening which extends to at least one of said front or back edges, said carton opening optionally overlaid with a plastic film having a dispensing slit extending along the front or back edge within the carton opening, wherein the clip of pre-folded, interfolded tissues is oriented within the carton such that the interfolded folds are parallel to the sidewalls of the carton. As used herein, "interfolded" tissues means that the tissues are interleaved. The tissues can be interleaved by any suitable means, including the use of an interfolder as is well known in the papermaking arts. If an interfolder is used, consecutive tissues will be attached to each other at perforation lines. In such cases the unperforated segments of the perforation lines should be sufficiently weak to permit the consecutive tissues to separate from each other upon removal from the carton. This can be controlled by the degree of perforation of the tissue sheet.

The carton opening must include at least one of the front or back top edges of the carton in order for the user to easily grasp and remove the tissues. Preferably, the carton opening spans portions of the top wall and the front wall.

When a plastic film with a dispensing slit is used to cover the carton opening to protect the tissues, there is preferably unsupported plastic film on either side of the slit. The dispensing slit is positioned along the top (front or back) edge of the carton. As used herein, "positioned along the edge" means that the slit is within about ¼ inch or less of the carton edge in order to allow the user to grasp the first tissue of the clip for dispensing. Once the first tissue is dispensed, the following tissues are pulled through the dispensing slit one at a time as a result of the interfolding, resulting in pop-up dispensing. Each successive tissue is held in place, partially exposed, by the dispensing slit.

A variety of surface attachment means can be used to attach the carton to various surfaces to further enhance its utility. Such means include hook-and-loop fastening tapes, pressure sensitive tapes, suction cups, clips, elastic bands and the like. Hook-and-loop fastening tapes, such as Velcro® tapes, can be used to attach the carton to any surfaces to which one portion of the hook-and-loop tape will adhere. The other portion is adhered to the tissue carton, such as on the rear wall. Alternatively, for adhering to some fabric surfaces, only the hook portion of the hook-and-loop pair needs to be adhered to the carton. Clips are useful for attachment to visors. Suction cups can attach to smooth surfaces such as glass.

The size of the carton is necessarily relatively thin compared to conventional tissue cartons in order to fit into narrow spaces found in automobiles, for example. The maximum depth (thinness) is about 3 inches, preferably about 2 inches or less, and still more preferably about 1.5 inches. The size of the front and back walls are about the size of the pre-folded, interfolded tissue. Interfolding results in the pre-folded tissue being folded in half. Accordingly, it has been found that the front and rear carton walls can be about 5 inches square (5 inches×5 inches) to accommodate typical full-sized facial tissue sheets which have been prefolded (c-folded or v-folded) and thereafter interfolded in half.

For ease of manufacture, the shape of the carton is rectangular, but can advantageously be wedge-shaped to improve the ability to wedge the carton into tight spaces, such as between the seat and the center console of the automobile. The sidewall shapes for the wedge-shaped carton can be triangular (resulting in no bottom wall), or they can be trapezoidal (requiring a bottom wall).

The area of the carton opening is such that tearing of the tissues or multiple sheet dispensing is avoided. In particular, if the carton opening is not covered with a plastic film with a dispensing slit, the carton opening area can be at least 3 square inches, more specifically from about 3 to about 7 square inches, and still more specifically from about 3 to about 4 square inches. If the plastic film is used, the carton opening can be larger.

DETAILED DESCRIPTION OF THE DRAWING

Figure 1:
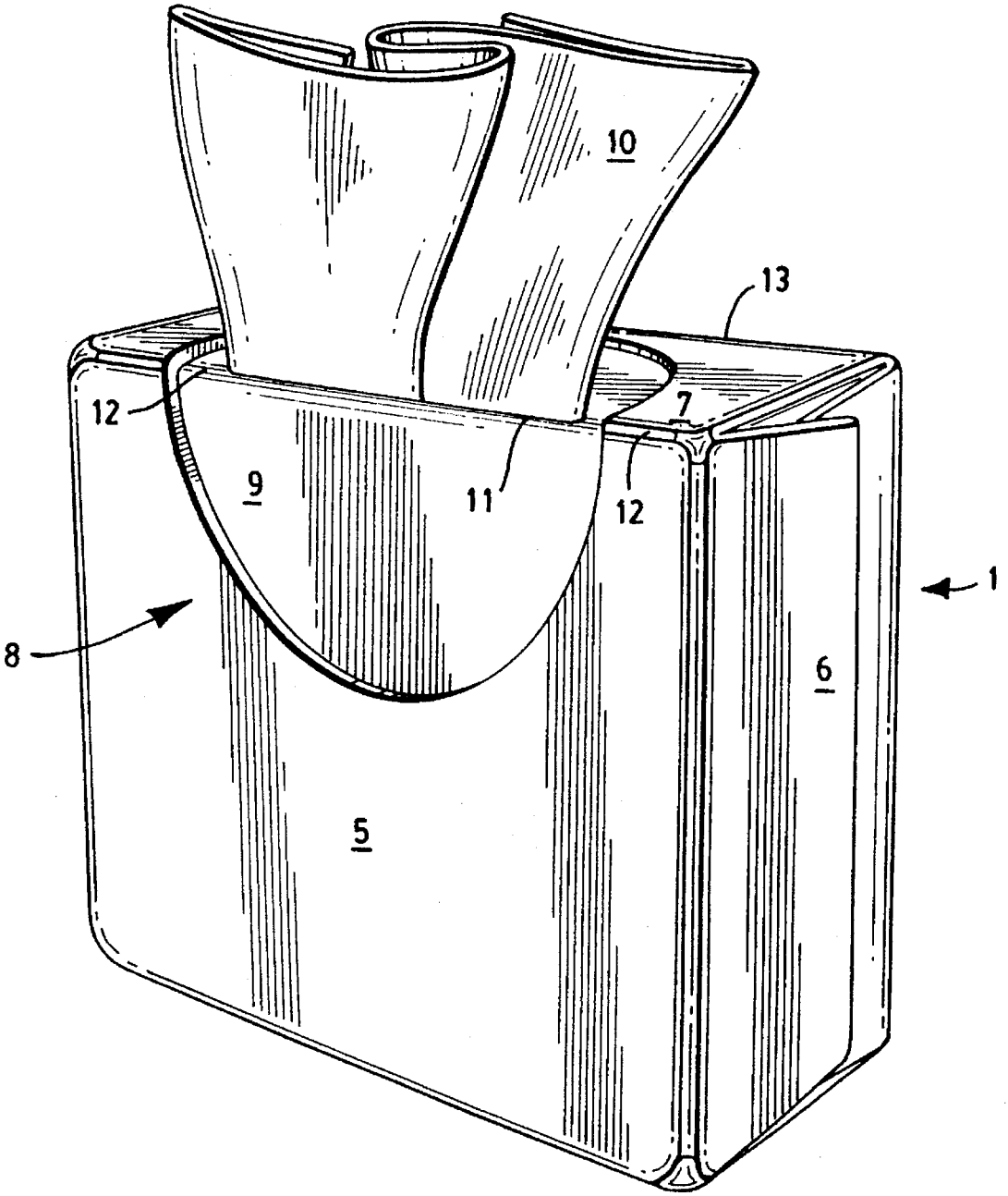
FIG. 1 is a perspective view of a product of this invention, illustrating the location of the dispensing slit and a partially withdrawn (popped up) facial tissue.

Referring to the Drawing, the invention will be described in further detail. The same reference numerals will be used to describe like features throughout the various figures.

FIG. 1 is a perspective view of a product of this invention comprising a carton 1 containing a clip of pre-folded, interfolded tissues. Shown is the front wall 5, side wall 6, top wall 7, carton opening 8, plastic film 9, a partially dispensed c-folded, interfolded facial tissue 10, dispensing slit 11 within the plastic film, front edge 12 formed by the intersection of the planes of the front and top walls, and back edge 13 formed by the intersection of the planes of the back and top walls. The presence of the plastic film 9 is optional, but is preferred for larger carton openings in order to protect the tissues within the carton and to provide (via the dispensing opening slit) sufficient resistance to prevent multiple dispensing.

Figure 2:
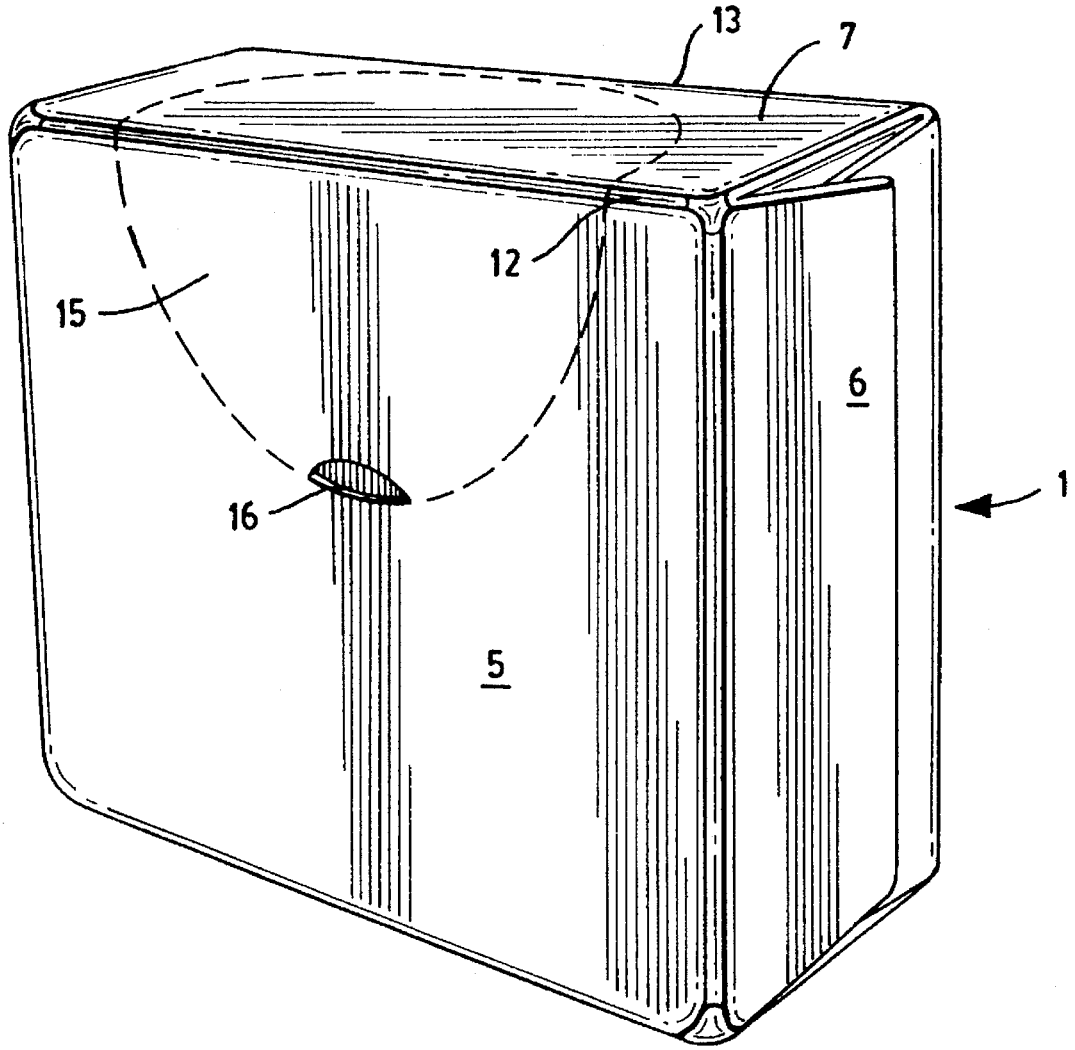
FIG. 2 is a perspective view of the carton of FIG. 1 prior to removal of the perforated panel forming the carton opening.

FIG. 2 is a perspective view of the carton of FIG. 1, illustrating the perforated removable panel 15 which, when removed, creates the carton opening. For convenience, the removable panel can contain a finger opening 16 to enable the user to easily grasp and remove the panel.

Figure 3:
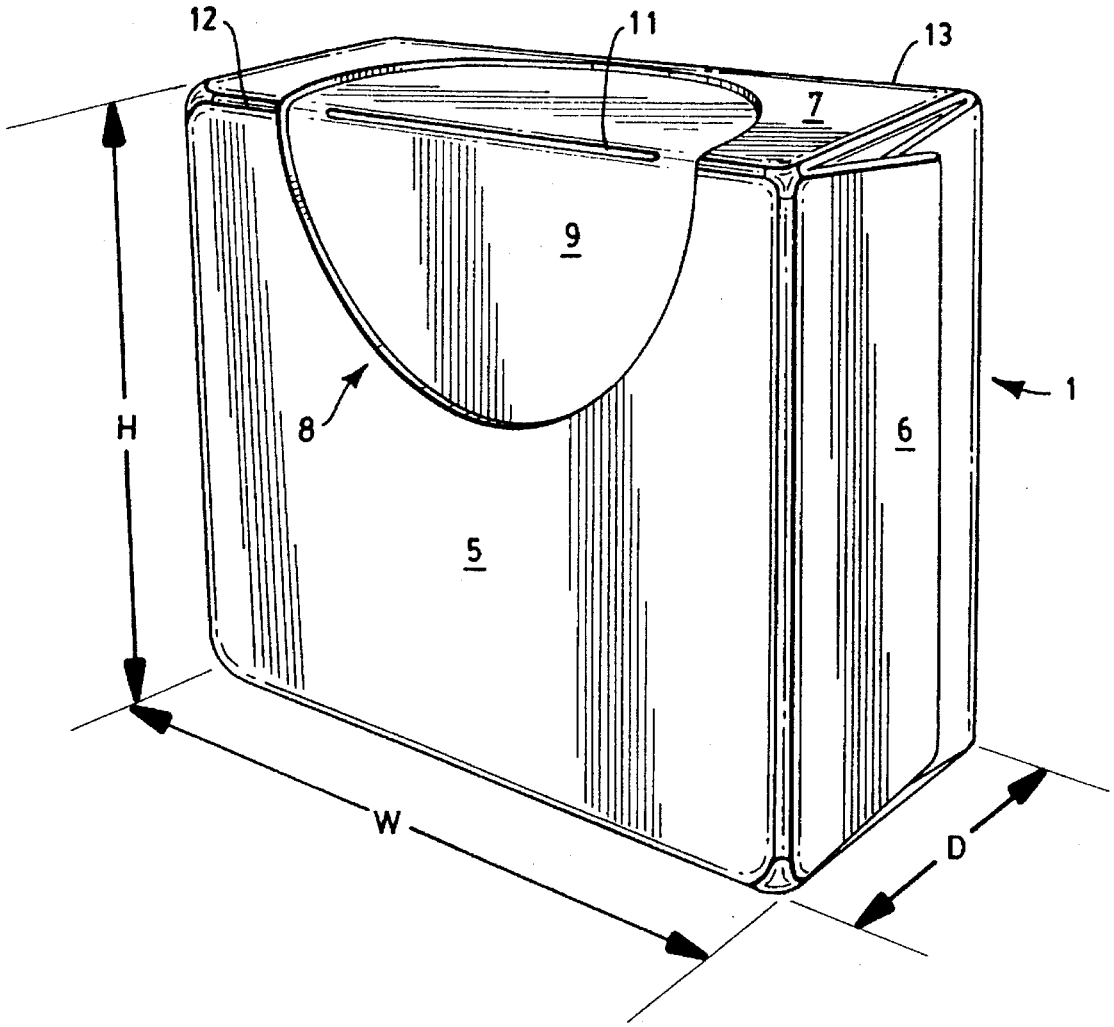
FIG. 3 is a perspective view of the carton of FIG. 2 after removal of the perforated panel, further illustrating the position of the dispensing slit at the intersection of the top and side walls.

FIG. 3 is a perspective view of the carton of FIG. 2 after the removable panel has been removed. The height of the carton is designated as dimension "H", the width is designated as dimension "W" and the depth (thickness) is designated as dimension "D".

Figure 4A:
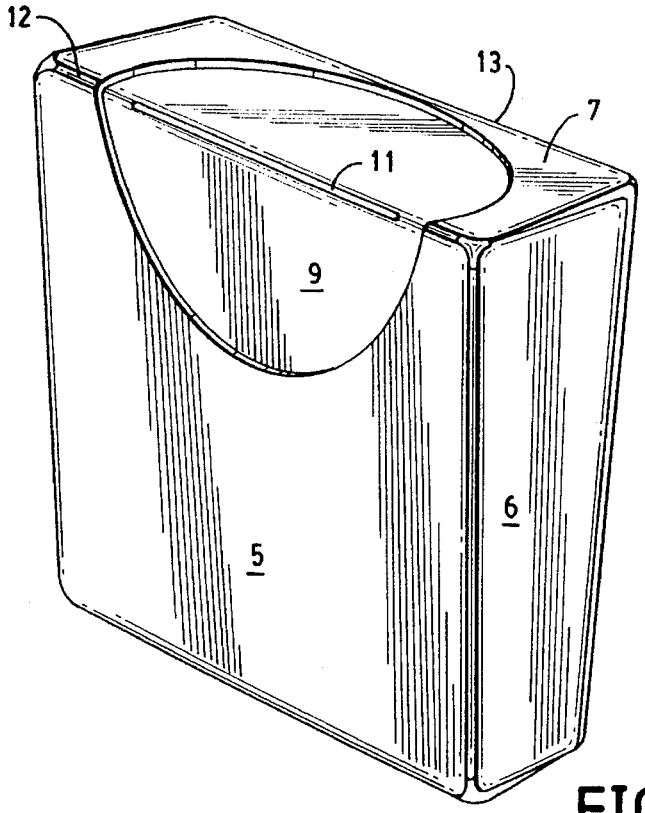
FIG. 4A is a perspective view of a carton of this invention having wedge shape.
Figure 4B:
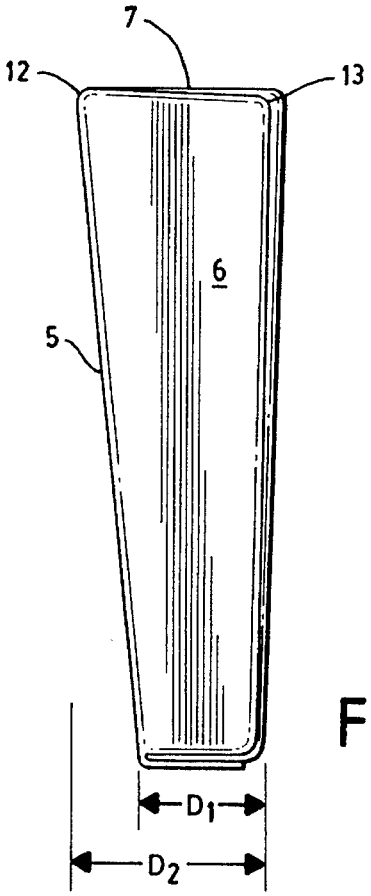
FIG. 4B is a side view of the carton of FIG. 4A further illustrating the taper of the sidewalls.

FIGS. 4A and 4B are a perspective view and a side view, respectively, of a wedge-shaped carton in accordance with this invention, which is especially useful for fitting into narrow spaces within the vehicle. The depth of the carton, because of the trapezoidal shape of the sidewalls, is indicated by two dimensions designated as "$D_1$" and "$D_2$".

Figure 5:
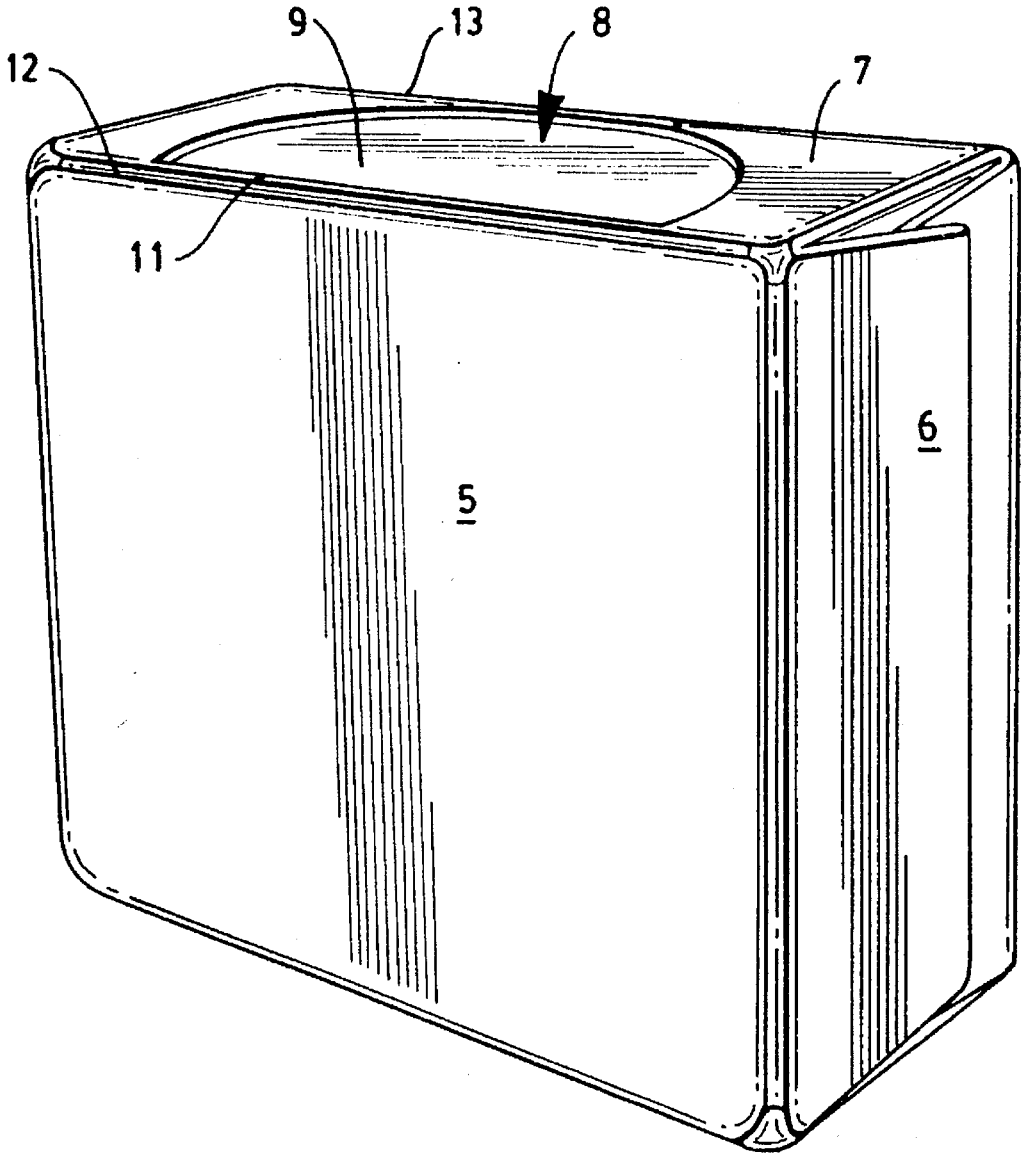
FIG. 5 is a perspective view of a carton of this invention having a carton opening in the top wall only, ending at the intersection of the top wall and the side wall.

FIG. 5 is a perspective view of a carton in accordance with this invention having a carton opening 8 which is in the top wall and ends at or about the front edge 12. Cartons having relatively small open areas such as shown do not require the optional plastic film/dispensing slit construction.

Figure 6:
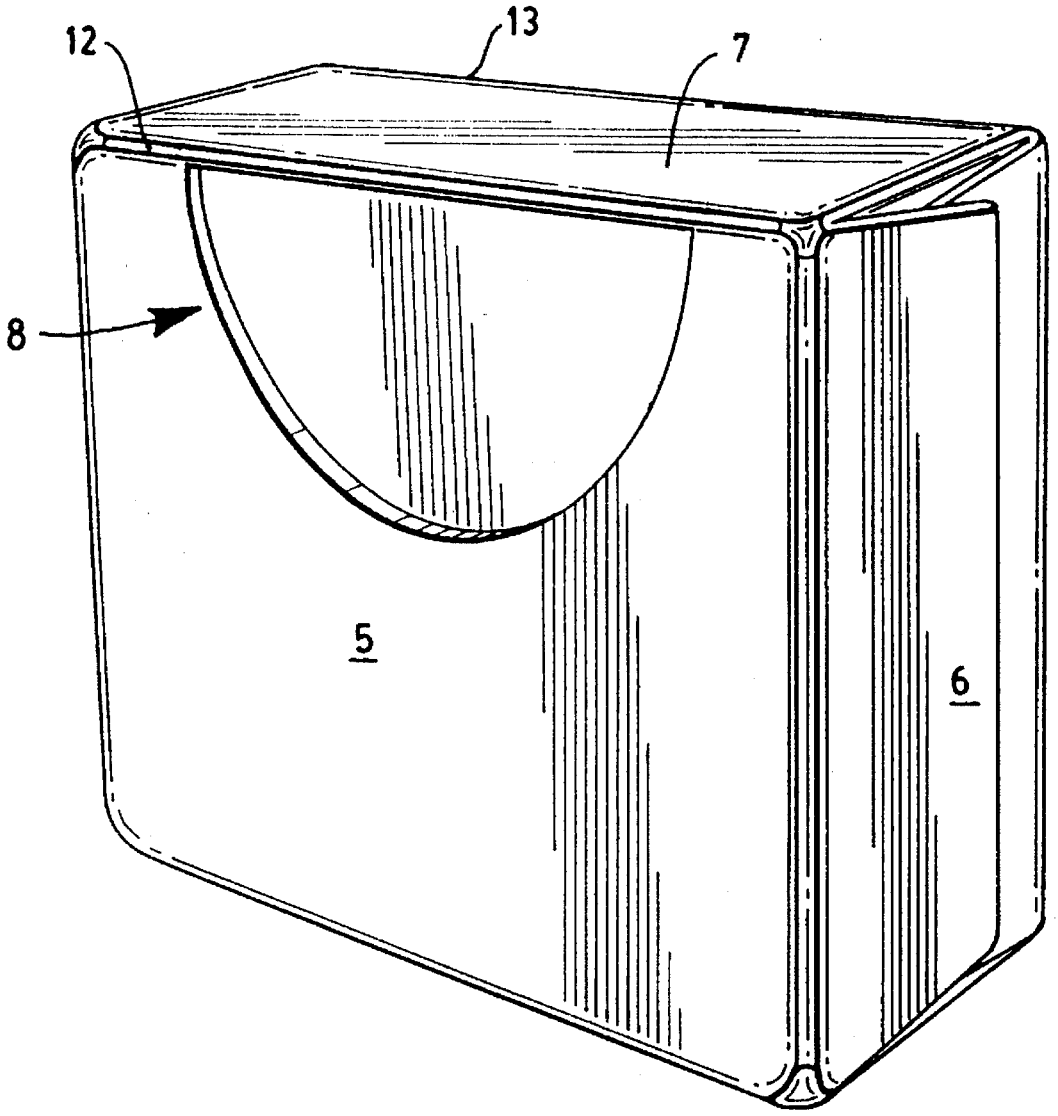
FIG. 6 is a perspective view of a carton of this invention having a carton opening in the side wall only, ending at the intersection of the side wall and the top wall.

FIG. 6 is a perspective view of a carton in accordance with this invention having a carton opening 8 which is in the front wall and ends at or near the front edge 12 similarly to that of FIG. 5. As shown, no plastic film is needed. For this configuration, a carton opening having a height of about 1.5 inches and a width of about 3 inches (area of 3.5 square inches) provides good dispensing.

Figure 7:
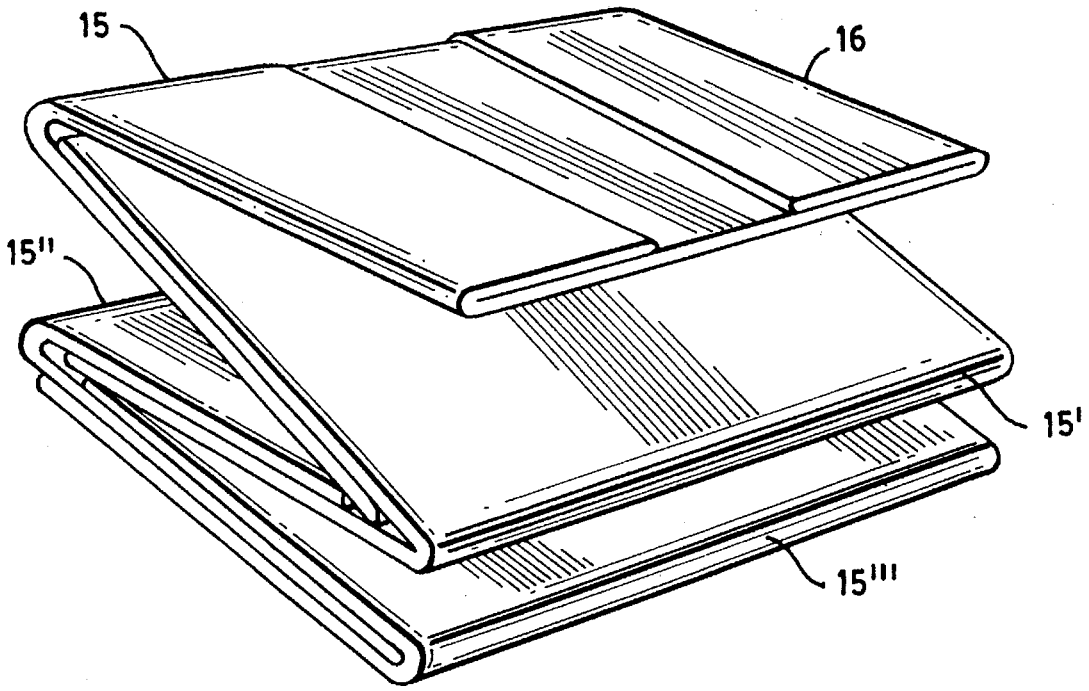
FIG. 7 is a perspective view of four c-folded tissues which have been interfolded to form a clip of tissues for use in accordance with this invention.

FIG. 7 is a perspective view of four c-folded, interfolded tissues forming a partial clip of tissues for use in accordance with this invention. Interfolded edges 15, 15', 15", and 15''', when placed in a carton, are positioned parallel to the sides of the carton, whereas c-folded edge 16 would be positioned at the top or bottom wall of the carton. This orientation of the clip provides the best dispensing.

EXAMPLES

In order to further illustrate the tissue carton of this invention, different cartons with different sheet counts and clip orientations were tested for dispensing effectiveness. For purposes of this study, the height and width dimensions of the cartons tested were chosen to accommodate a standard facial tissue folded in quarters (v-folded). Specifically, the height was 4¾ inches and the width was 4¾ inches. The cartons tested were of the design illustrated in FIG. 3. Carton depths were determined by a survey of the dimensions of a variety of vehicles. Stacks of facial tissue sheets, referred to as "clips", were hand made with different numbers of tissue sheets in each clip. All clips consisted of v-folded tissues which were subsequently interfolded. The clip was inserted into the cartons with the interfolded fold positioned at the top of the carton (fold up) or parallel to the sidewalls of the carton (this invention). The results of the dispensing study are summarized below in TABLE 1. (Carton depths are in inches.)

TABLE 1

| Clip Orientation | Carton Depth | Sheet Count | Dispensing Results |
|---|---|---|---|
| Fold Up | 1 ⅝ | 38 | First one failed to dispense. Every other one failed to dispense. |
| Fold Up | 1 ⅝ | 30 | Every other sheet |

TABLE 1-continued

| Clip Orientation | Carton Depth | Sheet Count | Dispensing Results |
|---|---|---|---|
| | | | failed to dispense. |
| Invention | 1 ½ | 32 | All dispensed. |
| Invention | 1 ½ | 40 | All dispensed. |
| Invention | 1 ⅝ | 39 | All dispensed. |

The foregoing results illustrate that positioning the interfolding folds in the tissue clip parallel to the sides of the carton (this invention) provides consistent pop-up dispensing for cartons of these dimensions.

The foregoing examples, given for purposes of illustration, are not to be construed as limiting the scope of this invention, which is defined by the following claims and all equivalents thereto.

We claim:

1. A pop-up tissue dispensing carton containing a clip of pre-folded interfolded tissues, said carton comprising a front wall, a rear wall, two side walls connecting the front and rear walls, a top wall, a front edge between the front wall and the top wall, and a back edge between the top wall and the rear wall, wherein the front and rear walls are about 5 inches square and the distance between the front and back walls is less than 3 inches, said carton having a carton opening which includes one of said front or back edges, wherein the clip of pre-folded interfolded tissues is oriented within the carton such that the interfolded tissue folds of the clip are parallel to the sidewalls of the carton.

2. The carton of claim 1 further comprising a surface attachment means.

3. The carton of claim 2 wherein the surface attachment means is a hook-and-loop fastener.

4. The carton of claim 2 wherein the surface attachment means is a pressure-sensitive tape.

5. The carton of claim 2 wherein the surface attachment means is a clip.

6. The carton of claim 1 further comprising a plastic film overlaying the carton opening, said plastic film having a dispensing slit within the carton opening and extending along the front edge or back edge of the carton.

7. The carton of claim 1 wherein the area of the carton opening is from about 3 to about 7 square inches.

8. The carton of claim 1 wherein the area of the carton opening is from about 3 to about 4 square inches.

9. A pop-up tissue dispensing carton containing a clip of pre-folded, interfolded tissues, said carton comprising a front wall, a rear wall, two side walls connecting the front and rear walls, a bottom wall and a top wall, and a front edge between the front wall and the top wall, wherein the front and rear walls are about 5 inches square and the distance between the front and back walls is less than 2 inches, said carton having a semicircular carton opening in a top portion of the front wall, wherein the clip of pre-folded, interfolded tissues is oriented within the carton such that the interfolded folds are parallel to the sidewalls of the carton.

10. The carton of claim 9 wherein the area of the carton opening is from about 3 to about 7 square inches.

11. The carton of claim 9 wherein the area of the carton opening is from about 3 to about 4 square inches.

12. A wedge-shaped pop-up tissue dispensing carton containing a clip of pre-folded, interfolded tissues, said carton comprising a front wall, a rear wall, two triangular- or trapezoid-shaped sidewalls connecting the front and rear walls, a top wall, a front edge between the top wall and front wall, and a back edge between the top wall and the rear wall, wherein the front and rear walls are about 5 inches square and the distance between the front and back walls, as measured at the top wall, is less than 3 inches, said carton having a carton opening which includes one of said front or back edges, wherein the clip of pre-folded, interfolded tissues is oriented within the carton such that the interfolded folds are parallel to the sidewalls of the carton.

13. The carton of claim 12 having triangular-shaped sidewalls.

14. The carton of claim 12 having trapezoidal-shaped sidewalls.

15. The carton of claim 12 further comprising a plastic film overlaying the carton opening, Said plastic film having a dispensing slit within the carton opening and extending along the front edge of the carton.

16. The carton of claim 12 wherein the area of the carton opening is from about 3 to about 7 square inches.

17. The carton of claim 12 wherein the area of the carton opening is from about 3 to about 4 square inches.

18. The carton of claim 12 further comprising a surface attachment means.

19. The carton of claim 12 further comprising a hook-and-loop surface attachment means.

* * * * *